US007185967B2

(12) United States Patent
Endo

(10) Patent No.: US 7,185,967 B2
(45) Date of Patent: Mar. 6, 2007

(54) PRINTING APPARATUS, PATTERN, AND COMPUTER SYSTEM

(75) Inventor: Hironori Endo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/780,859

(22) Filed: Feb. 19, 2004

(65) Prior Publication Data

US 2004/0160469 A1 Aug. 19, 2004

Related U.S. Application Data

(62) Division of application No. 10/370,070, filed on Feb. 21, 2003, now Pat. No. 6,964,465.

(30) Foreign Application Priority Data

Feb. 21, 2002 (JP) ..... 2002-045204
Feb. 22, 2002 (JP) ..... 2002-046444
Feb. 22, 2002 (JP) ..... 2002-046445

(51) Int. Cl.
*B41J 29/393* (2006.01)

(52) U.S. Cl. ..... 347/19

(58) Field of Classification Search ..... 347/19; 400/74

See application file for complete search history.

(56) References Cited

U.S. PATENT DOCUMENTS 5,448,269 A 9/1995 Beauchamp et al. ..... 347/19
6,082,911 A 7/2000 Murakami
6,126,345 A 10/2000 Ito et al. ..... 400/74
6,137,592 A 10/2000 Arquilevich et al. ..... 358/1.8
6,196,736 B1 * 3/2001 Otsuki et al. ..... 400/124.01
6,439,684 B1 8/2002 Yoshimura et al. ..... 347/19
6,464,321 B1 * 10/2002 Nunokawa ..... 347/19
6,523,926 B1 * 2/2003 Mitsuzawa et al. ..... 347/19
6,692,096 B1 * 2/2004 Otsuki et al. ..... 347/14
6,769,759 B2 8/2004 Yamasaki et al. ..... 347/19
6,832,825 B1 * 12/2004 Nishikori et al. ..... 347/19
2001/0030671 A1 * 10/2001 Fujimori ..... 347/19

FOREIGN PATENT DOCUMENTS

JP 10-329381 12/1998
JP 11-49399 2/1999
JP 2001-10088 * 1/2001 ..... 347/19

* cited by examiner

*Primary Examiner*—Julian D. Huffman
(74) *Attorney, Agent, or Firm*—Sughrue Mion, PLLC

(57) ABSTRACT

A printing apparatus comprises an ejection head for selectively ejecting ink droplets of a plurality of sizes to form dots on a printing medium. The printing apparatus is capable of printing a correction pattern on the printing medium, the correction pattern enabling correction of a misalignment between a position at which dots are formed during a forward pass through which the head is moved and a position at which dots are formed during a return pass through which the head is moved, and a spacing in a sub-scanning direction between dots that make up the correction pattern printed by ejecting ink droplets of a certain size from the ejection head is different from a spacing in the sub-scanning direction between dots that make up the correction pattern printed by ejecting ink droplets of a different size from the ejection head.

9 Claims, 16 Drawing Sheets

PRINTING APPARATUS, PATTERN, AND COMPUTER SYSTEM

CROSS-REFERENCE TO RELATED APPLICATIONS

This application is a divisional application of application Ser. No. 10/370,070, filed Feb. 21, 2003 now U.S. Pat. No. 6,964,465, the disclosure of which is incorporated herein by reference. The present application claims priority on Japanese Patent Application No. 2002-45204 filed on Feb. 21, 2002, Japanese Patent Application No. 2002-46444 filed on Feb. 22, 2002, and Japanese Patent Application No. 2002-46445 filed on Feb. 22, 2002, which are herein incorporated by reference.

BACKGROUND OF THE INVENTION

1. Field of the Invention

The present invention relates to a printing apparatus, a correction pattern, and a computer system.

2. Description of the Related Art

In recent years, a type of color printer that ejects several colors of ink from its head has gained wide popularity as an output apparatus for computers. Some such inkjet color printers have a function for performing so-called "bidirectional printing" in order to increase the printing speed.

Also, inkjet printers were only capable of reproducing each pixel according to binary values of on and off; however, in recent years, multivalue printers that are capable of reproducing a single pixel with multiple values, such as three or more values, have also been proposed. Multivalue pixels can be formed by ejecting ink droplets of the same color for a single pixel in a plurality of sizes, for example.

When performing bidirectional printing using a multivalue printer, with which a plurality of ink droplets are ejected for a single pixel, the image quality may be deteriorated due to differences in the printing characteristics in the forward pass and in the return pass. For example, when the positions where ink droplets of various sizes land in the main-scanning direction are different during the forward pass and the return pass, the image quality is deteriorated as a result.

SUMMARY OF THE INVENTION

An aspect of the invention has been made to solve the foregoing problem, and it is an object thereof to prevent deterioration of image quality caused by differences in the printing characteristics during the forward pass and the return pass when bidirectional printing is carried out using a multivalue printer.

A main invention for achieving the foregoing object is a printing apparatus comprising: an ejection head for selectively ejecting ink droplets of a plurality of sizes to form dots on a printing medium; wherein the printing apparatus is capable of printing a correction pattern on the printing medium, the correction pattern enabling correction of a misalignment between a position at which dots are formed during a forward pass through which the head is moved and a position at which dots are formed during a return pass through which the head is moved, and a spacing in a sub-scanning direction between dots that make up the correction pattern printed by ejecting ink droplets of a certain size from the ejection head is different from a spacing in the sub-scanning direction between dots that make up the correction pattern printed by ejecting ink droplets of a different size from the ejection head.

Features and objects of the present invention other than the above will become clear by reading the description of the present specification with reference to the appended drawings.

Figure 1:
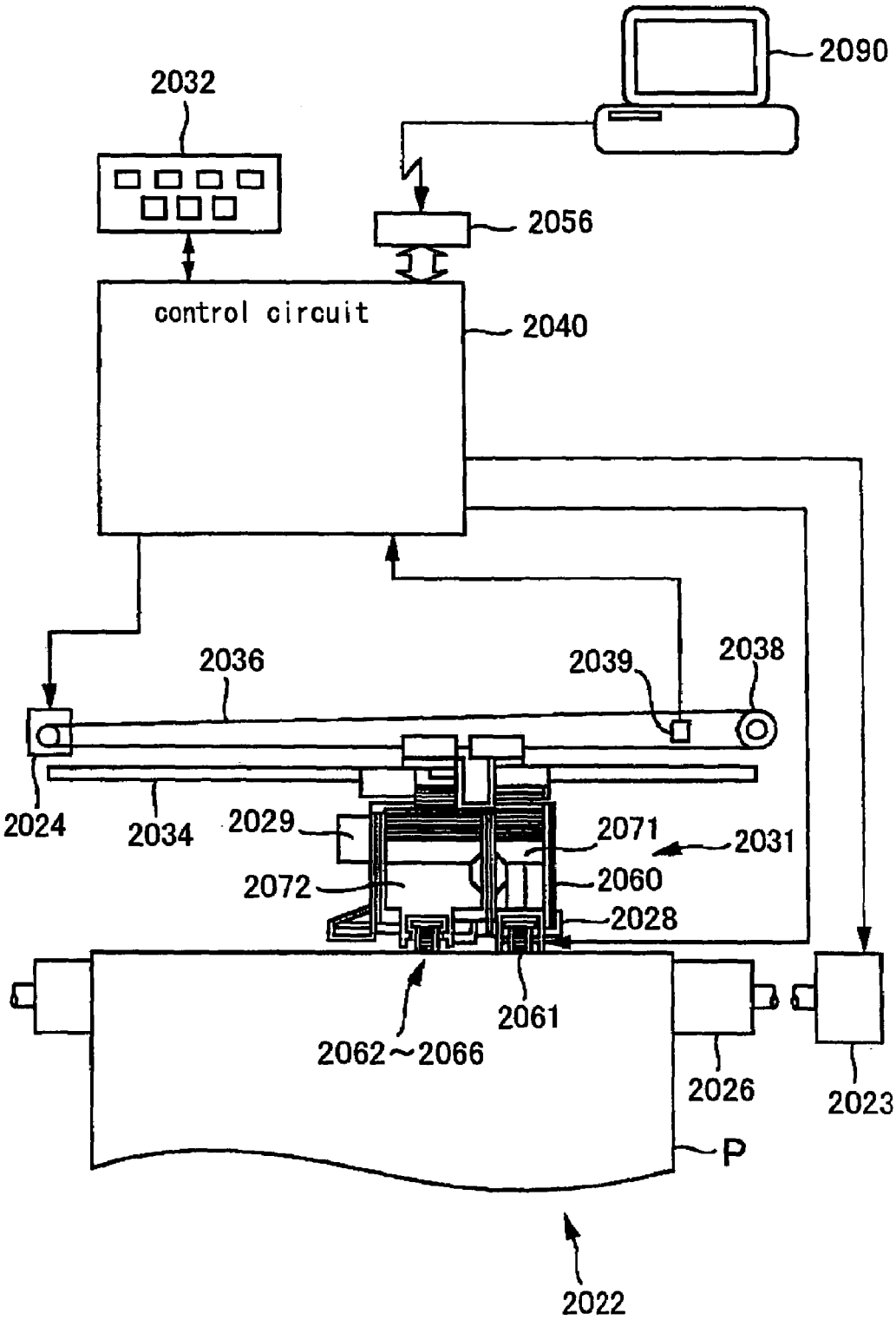
FIG. 1 is a diagram that schematically shows the configuration of a printing system provided with a inkjet printer 2022.

For a more complete understanding of the present invention and the advantages thereof, reference is now made to the following description taken in conjunction with the accompanying drawings.

DESCRIPTION OF PREFERRED EMBODIMENTS

<Outline of the Disclosure>

At least the following matters will be made clear by the explanation in the present specification and the description of the accompanying drawings.

A printing apparatus comprises:

an ejection head for selectively ejecting ink droplets of a plurality of sizes to form dots on a printing medium;

wherein the printing apparatus is capable of printing a correction pattern on the printing medium, the correction pattern enabling correction of a misalignment between a position at which dots are formed during a forward pass through which the head is moved and a position at which dots are formed during a return pass through which the head is moved, and a spacing in a sub-scanning direction between dots that make up the correction pattern printed by ejecting ink droplets of a certain size from the ejection head is different from a spacing in the sub-scanning direction between dots that make up the correction pattern printed by ejecting ink droplets of a different size from the ejection head.

If the size of the ink droplets that are ejected from the ejection head are different, the size of the dots that are formed on the printing medium are accordingly different, altering the darkness of the correction pattern. Consequently, there are occasions in which, even though a density of the correction pattern formed in accordance with ink droplets of a certain size is appropriate, a density of a correction pattern formed in accordance with ink droplets of another size is not preferable. According to the present invention, the spacing, in the sub-scanning direction, between dots forming the correction pattern printed by ejecting ink droplets of a certain size is different from the spacing, in the sub-scanning direction, between dots forming the correction pattern printed by ejecting ink droplets of another size. Thus, correction patterns of a darkness suiting the size of the ink droplets can be formed.

In this printing apparatus, it is preferable that the correction pattern has a plurality of sub-patterns, and each sub-pattern is made of dots arranged in a main-scanning direction and the sub-scanning direction. According to such a printing apparatus, the correction pattern has a plurality of sub-patterns and each sub-pattern is made of dots arranged in the main-scanning direction and in the sub-scanning direction. Therefore, it is possible to form a correction pattern that allows easy visual confirmation or with which the density can be detected easily.

In this printing apparatus, it is preferable that each sub-pattern has forward-pass dots that are formed with a predetermined spacing therebetween during the forward pass through which the head is moved and return-pass dots that are formed with a predetermined spacing therebetween during the return pass through which the head is moved, and an amount of misalignment between a position at which the forward-pass dots are formed and a position at which the return-pass dots are formed is different for each sub-pattern. According to such a printing apparatus, since each sub-pattern has forward-pass dots that are formed with a predetermined spacing therebetween during the forward pass through which the head is moved and return-pass dots that are formed with a predetermined spacing therebetween during the return pass through which the head is moved, and since an amount of misalignment between a position at which the forward-pass dots are formed and a position at which the return-pass dots are formed is different for each sub-pattern, a correction pattern with which the darkness can be easily confirmed visually or with which the density is easily detected can be formed.

In this printing apparatus, it is preferable that a spacing in a main-scanning direction between the dots forming the correction pattern is the same regardless of the size. When the spacing in the main-scanning direction between the dots forming the correction pattern is reduced in order to raise the density of the correction pattern formed by ejecting small-sized ink droplets, dots that are adjacent to one another in the main-scanning direction will fuse with one another, causing the problem of bleeding. With this printing apparatus, since the spacing in the main-scanning direction between the dots forming the correction pattern is the same regardless of the size of the dots, the occurrence of bleeding can be inhibited.

In this printing apparatus, it is preferable that the predetermined spacing is at least twice the spacing in the sub-scanning direction between the dots. When the dot spacing in the forward pass and the return pass of main scanning is reduced, dots that are adjacent to one another in the main-scanning direction will fuse with one another, causing the problem of bleeding. With this printing apparatus, since the predetermined spacing is at least twice the spacing in the sub-scanning direction between the dots, the occurrence of bleeding can be inhibited.

In this printing apparatus, it is preferable that the printing apparatus further includes a density detection member for detecting a density of the sub-patterns; wherein the misalignment between a position at which dots are formed during a forward pass through which the head is moved and a position at which dots are formed during a return pass through which the head is moved is corrected based on a result of the density detected by the density detection member. According to this printing apparatus, misalignments in the dot positions can be accurately corrected based on the correction pattern in which the density has been optimized to suit the dot size.

A printing apparatus comprises:

an ejection head for selectively ejecting ink droplets of a plurality of sizes to form dots on a printing medium;

wherein the printing apparatus is capable of printing a correction pattern on the printing medium, the correction pattern enabling correction of a misalignment between a position at which dots are formed during a forward pass through which the head is moved and a position at which dots are formed during a return pass through which the head is moved, a spacing in a sub-scanning direction between dots that make up the correction pattern printed by ejecting ink droplets of a certain size from the ejection head is different from a spacing in the sub-scanning direction between dots that make up the correction pattern printed by ejecting ink droplets of a different size from the ejection head, and the printing apparatus is capable of receiving command information from a user based on the correction pattern, and, based on the command information, correcting a misalignment between a position at which dots are formed during a forward pass through which the head is moved and a position at which dots are formed during a return pass through which the head is moved.

According to this printing apparatus, misalignments in dot positions can be accurately corrected using user command information based on the correction pattern, which can be visually confirmed easily.

It should be noted that in addition to such a printing apparatus, a correction pattern and computer systems are also described.

<Overview of the Printing Apparatus>

Figure 2:
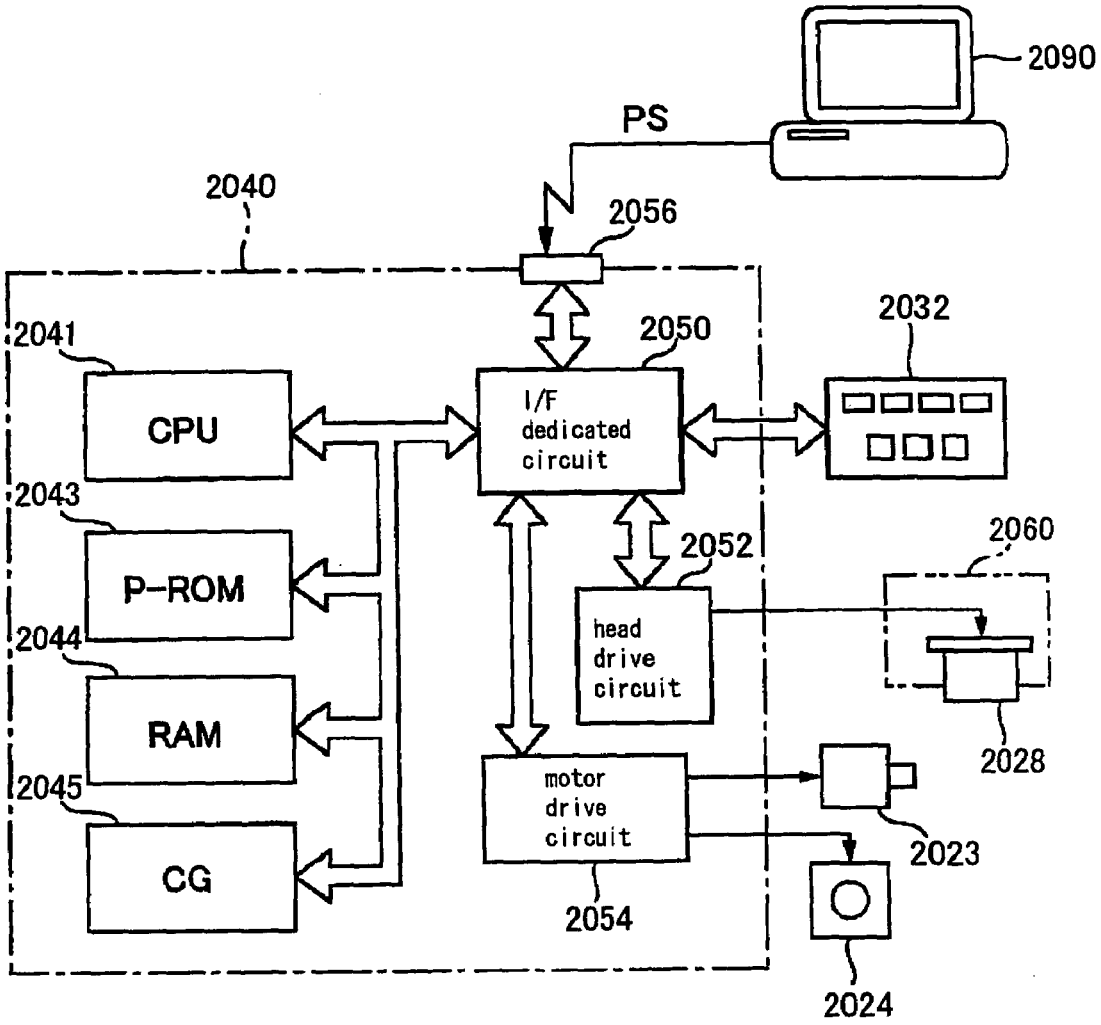
FIG. 2 is a block diagram showing the configuration of the printer 2022, centering on a control circuit 2040.

First, an overview of the printing apparatus is described with reference to FIG. 1 and FIG. 2. FIG. 1 is a diagram schematically showing the configuration of a printing system provided with an inkjet printer 2022. FIG. 2 is a block diagram showing the configuration of the printer 2022, focusing on its control circuit 2040.

The printer 2022 has a sub-scanning mechanism for carrying a print paper P with a paper-feed motor 2023, and a main-scanning mechanism for moving a cartridge 2031 back and forth in the axial direction of a platen 2026 using a carriage motor 2024. Here, the direction in which the print paper P is carried by the sub-scanning mechanism is called the sub-scanning direction, and the direction in which the cartridge 2031 is moved by the main-scanning mechanism is called the main-scanning direction. It should be noted that the carriage 2031 is provided with a reflection-type optical sensor 2029, which will be described later.

The printer 2022 also comprises: a head drive mechanism for driving an ejection head unit 2060 (also referred to as "ejection head assembly"), which is mounted on the cartridge 2031, so as to control the ejection of ink and dot formation; and the control circuit 2040 for managing the exchange of signals between the head drive mechanism and the paper-feed motor 2023, the carriage motor 2024, the ejection head unit 2060, and an operation panel 2032. The control circuit 2040 is connected to a computer 2090 via a connector 2056.

The sub-scanning mechanism for carrying the print paper P is provided with a gear train (illustration omitted) that transmits the rotation of the paper-feed motor 2023 to the platen 2026 and to a paper-carry roller (not shown). The main-scanning mechanism for moving the carriage 2031 back and forth also comprises: a slide shaft 2034 that is provided parallel to the axis of the platen 2026 and that slidably supports the carriage 2031; a pulley 2038 that is provided with an endless drive belt 2036 extended between itself and the carriage motor 2024; and a position detection sensor 2039 for detecting the position of origin of the carriage 2031.

As shown in FIG. 2, the control circuit 2040 is configured as an arithmetic and logic circuit provided with a CPU 2041, a programmable ROM (PROM) 2043, a RAM 2044, and a character generator (CG) 2045 storing the dot matrix of characters. The control circuit 2040 further comprises: an I/F dedicated circuit 2050 that acts as a dedicated interface with, for example, outside motors; a head drive circuit 2052 that is connected to the I/F dedicated circuit 2050 and that drives the ejection head unit 2060 so that the unit ejects ink; and a motor drive circuit 2054 for driving the paper-feed motor 2023 and the carriage motor 2024. The I/F dedicated circuit 2050 comprises therein a parallel interface circuit and is capable of receiving print signals PS that are supplied from the computer 2090 via the connector 2056.

<Example Configuration of the Reflection-Type Optical Sensor>

Figure 3:
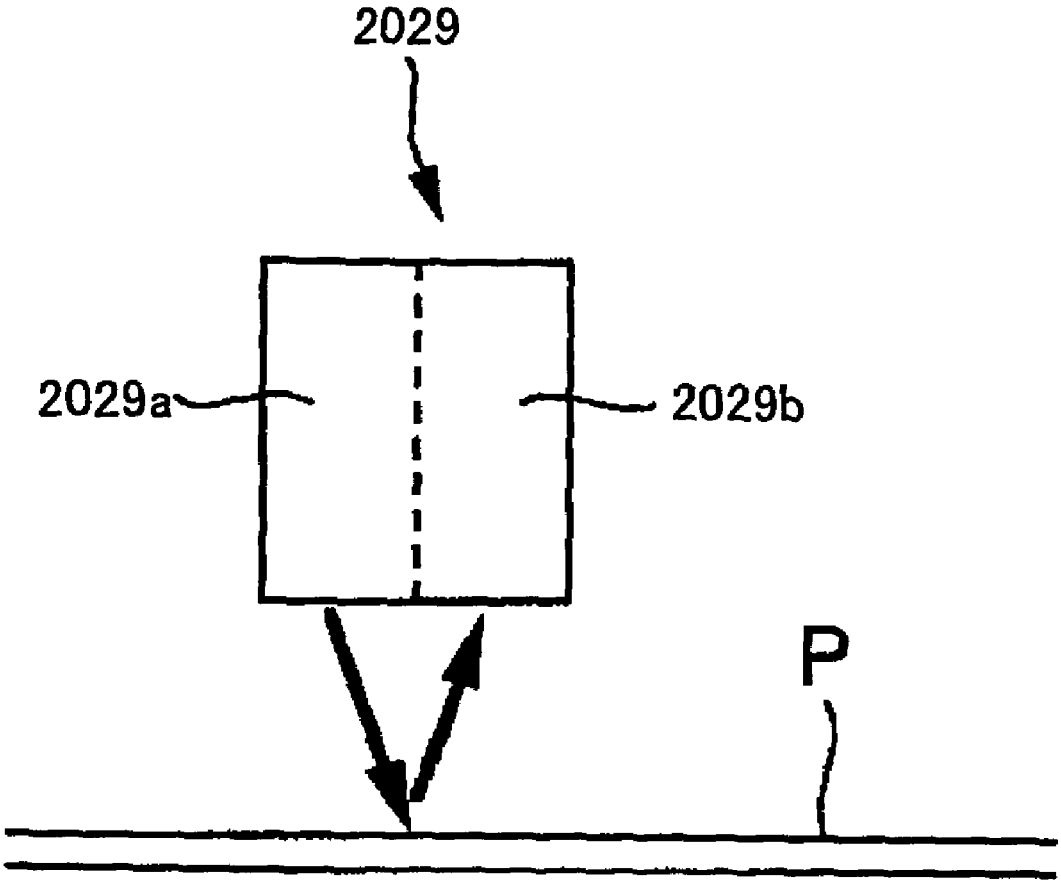
FIG. 3 is a schematic drawing for describing an example of a reflection-type optical sensor 2029.

Next, an example of the configuration of the reflection-type optical sensor is described with reference to FIG. 3. FIG. 3 is a schematic drawing for describing an example of the reflection-type optical sensor 2029.

The reflection-type optical sensor 2029 is attached to the carriage 2031, and has a light-emitting section 2029*a* that is made of, for example, a light-emitting diode, and a light-receiving section 2029*b* that is made of, for example, a phototransistor. The light that is emitted from the light-emitting section 2029*a*, that is, the incident light, is reflected by the print paper P, and the reflected light is received by the light-receiving section 2029*b* and converted into an electrical signal. The magnitude of the electrical signal is measured as the output value of the light-receiving sensor corresponding to the intensity of the reflected light that is received. Consequently, the reflection-type optical sensor 2029 functions as a density detection member for detecting the density of the pattern that is printed on the print paper P.

It should be noted that in the above description, as shown in the drawing, the light-emitting section 2029*a* and the light-receiving section 2029*b* are configured in a single unit as a device that serves as the reflection-type optical sensor 2029; however, they may each constitute a separate device, such as a light-emitting device and a light-receiving device.

Also, in the above description, in order to obtain the intensity of the reflected light that is received, the magnitude of the electric signals is measured after the reflected light is converted into electrical signals; however, this is not a limitation, and it is sufficient if it is possible to measure the output value of the light-receiving sensor corresponding to the intensity of the reflected light that is received.

<Configuration of the Ejection Heads>

Figure 4:
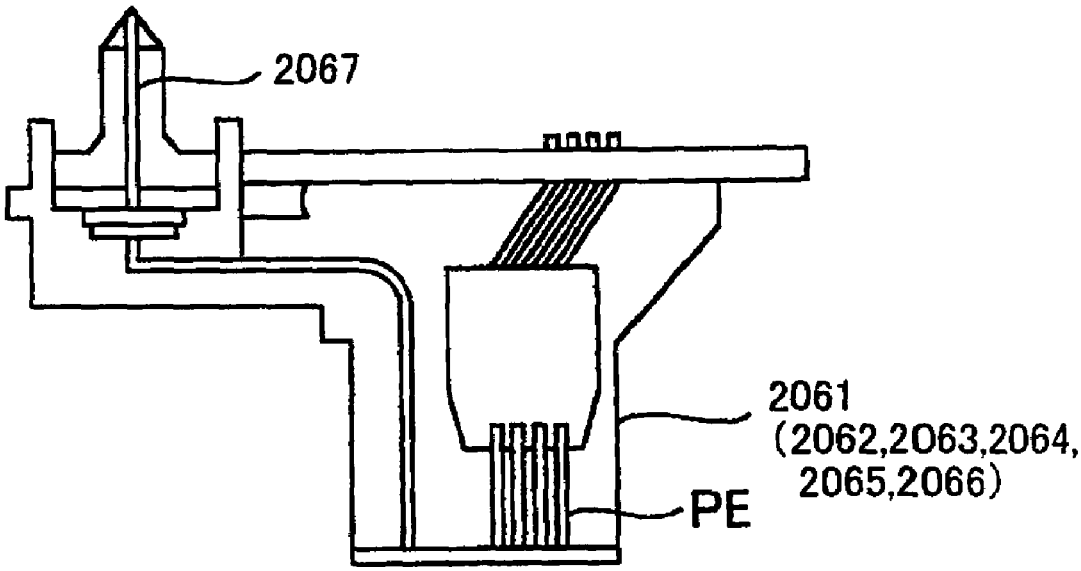
FIG. 4 is a diagram that schematically shows the internal configuration of the ejection heads.
Figure 4:
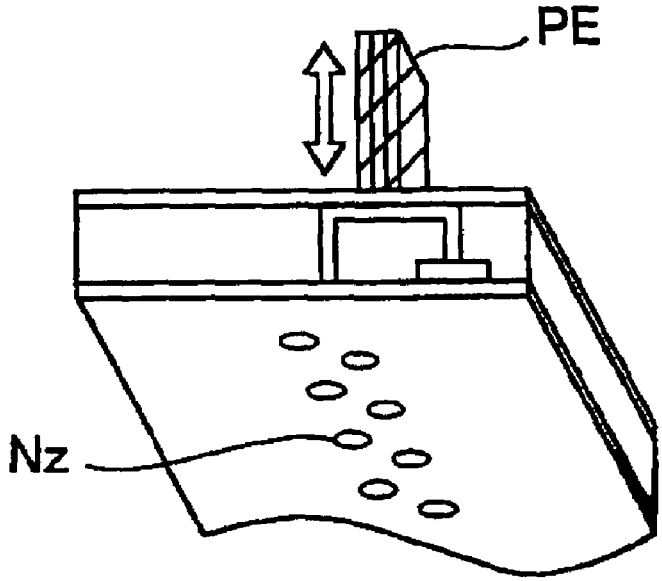
Figure 5:
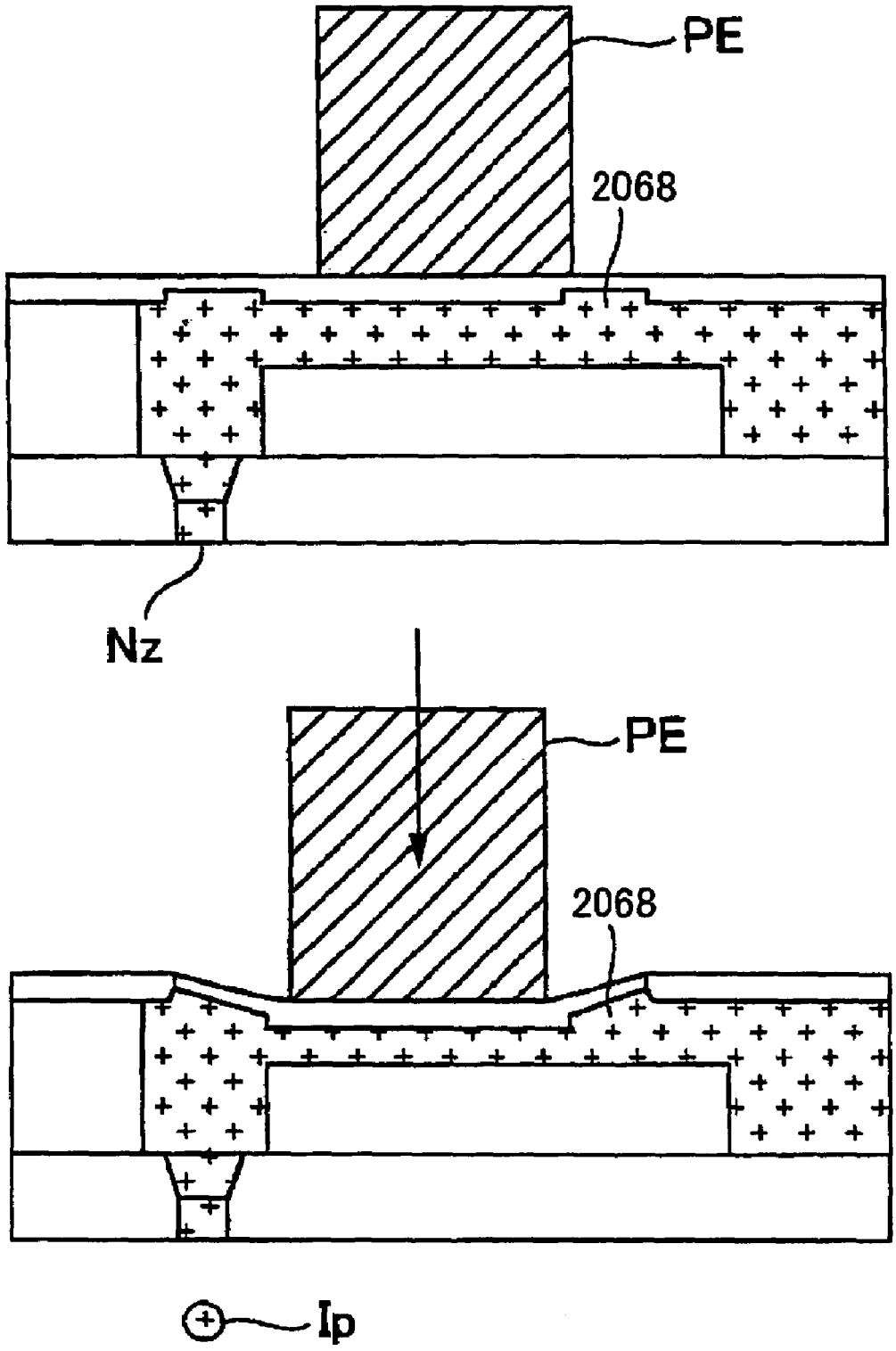
FIG. 5 is an explanatory diagram that shows in detail the structure of the piezo elements PE and the nozzles Nz.
Figure 6:
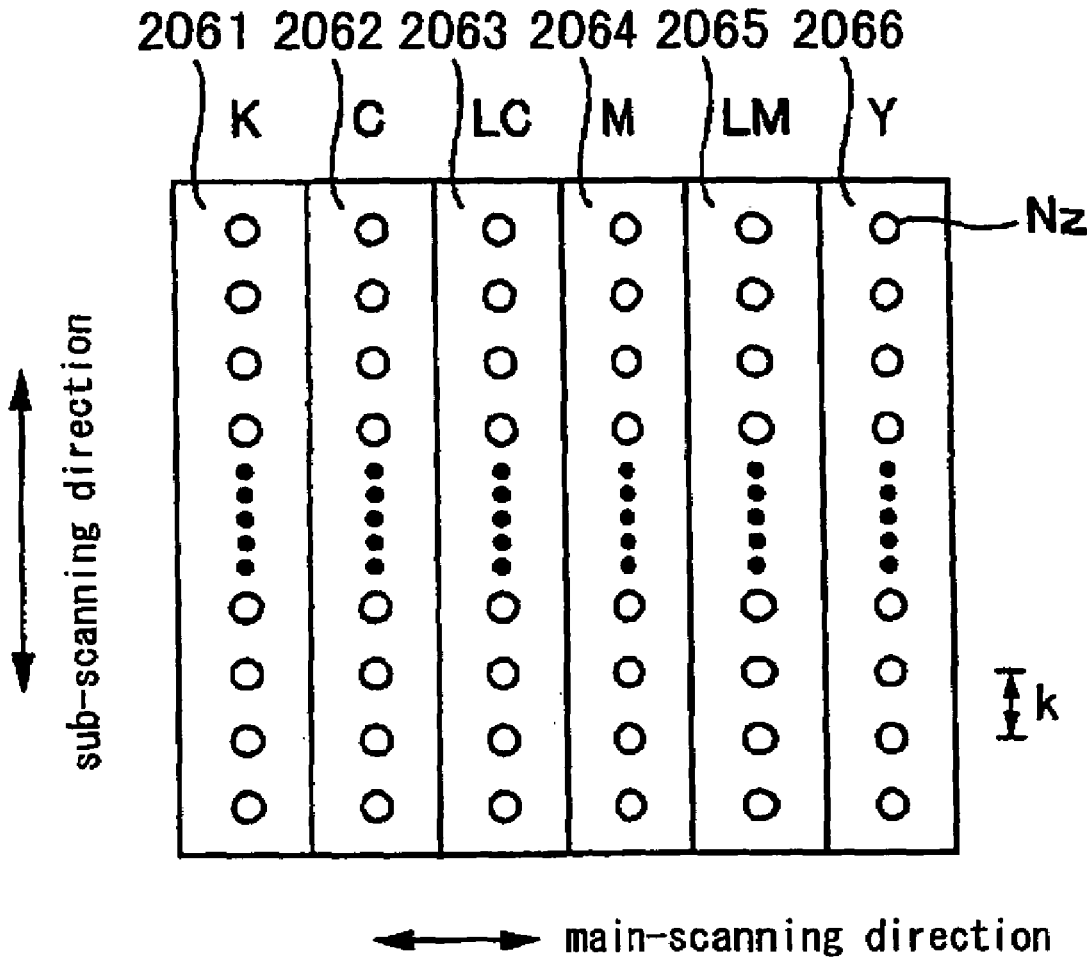
FIG. 6 is an explanatory diagram showing the arrangement of the inkjet nozzles Nz in ejection heads 2061 to 2066.

Next, the configuration of the ejection heads is described with reference to FIG. 4, FIG. 5, and FIG. 6. FIG. 4 is an explanatory diagram that schematically shows the internal configuration of the ejection heads. FIG. 5 is an explanatory diagram that shows in detail the structure of the piezo elements PE and the nozzles Nz. FIG. 6 is an explanatory diagram that shows the arrangement of the inkjet nozzles Nz in the ejection heads 2061 to 2066.

A cartridge 2071 for black ink (K) and a color ink cartridge 2072 containing five colors of ink, which are cyan (C), light cyan (LC), magenta (M), light magenta (LM), and yellow (Y), can be fitted into the carriage 2031 (FIG. 1).

A total of six ejection heads 2061 to 2066 are disposed in the lower portion the carriage 2031, and in the bottom portion of the carriage 2031 are provided introduction tubes 2067 (see FIG. 4) for guiding ink from the ink tanks to the ejection heads for each color. When the cartridge 2071 for black ink (K) and the color cartridge 2072 are fitted into the carriage 2031 from above, the introduction tubes 2067 are inserted into connection apertures provided in each cartridge, allowing ink to be supplied from each ink cartridge to the ejection heads 2061 to 2066.

When the ink cartridges 2071 and 2072 are fitted into the carriage 2031, then, as shown in FIG. 4, the ink inside the ink cartridges is sucked out via the introduction tubes 2067 and guided to the ejection heads 2061 to 2066 provided in the lower portion of the carriage 2031.

In the ejection heads 2061 to 2066 for each color, which are provided in the lower portion of the cartridge 2031, are disposed piezo elements PE, which are a kind of electrostrictive element with excellent responsiveness, for each nozzle. Also, as shown in the top half of FIG. 5, the piezo elements PE are disposed in positions that contact an ink passage 2068 for guiding ink to the nozzles Nz. As is well known in the art, when voltage is applied to the piezo elements PE, their crystalline structure is deformed and they convert the electrical energy into mechanical energy very quickly. In this embodiment, by applying a voltage of a predetermined duration between the electrodes that are provided on both sides of the piezo elements PE, the piezo elements PE expand only for the amount of time that voltage is applied as shown in the bottom half of FIG. 5, altering the shape of one side of the ink passage 2068. As a result, the volume of the ink passages 2068 is reduced in correspondence with the expansion of the piezo elements PE, and an amount of ink that corresponds to this reduction is quickly ejected from the tip of the nozzles Nz as ink droplets Ip. Printing is carried out by the formation of dots as the ink droplets Ip soak into the paper P that is mounted on the platen 26.

As shown in FIG. 6, the inkjet nozzles Nz in the ejection heads 2061 to 2066 are arranged in six nozzle row groups that eject ink for each color: black (K), cyan (C), light cyan (LC), magenta (M), light magenta (LM), and yellow (Y). The 48 nozzles Nz in each nozzle row are arranged in a row at a constant nozzle pitch k.

Although the printer 2022 is provided with nozzles Nz of a constant diameter as shown in FIG. 6, the nozzles Nz can be used to form a plurality of types of ink droplets having different amounts of ink. This is carried out by changing the drive waveform for driving the piezo elements PE. More specifically, by changing the rate of change at which the drive voltage of the piezo elements PE is to be turned to a negative voltage or by changing the peak voltage of the drive waveform, ink droplets having differing ink amounts can be formed with a single nozzle.

With the printer 2022 having the physical configuration described above, the paper P is carried by the paper-feed motor 2023 while the carriage 2031 is moved back and forth by the carriage motor 2024, and at the same time, the piezo elements PE of the ejection heads 2061 to 2066 are driven so as to eject the various colors of ink, forming dots and creating a multicolor image on the paper P.

It should be noted that here the printer 2022 that is used is provided with heads for ejecting ink using the piezo elements PE in the manner mentioned above, however, it is also possible to use a variety of elements other than piezo elements as the ejection drive elements. For example, the present invention can also be applied to a printer provided with ejection drive elements with which ink is ejected due to foams (bubbles) generated within the ink passages by passing a current through heaters disposed on the ink passages. Also, the control circuit 2040 may have any configuration, as long as it selectively records one of a plurality of types of dots of different sizes at each pixel position by supplying drive signals to each ejection drive element so as to cause one or more ink droplets to be selectively ejected from each nozzle, and as long as it generates drive signals so that the temporal ejection order of the plurality of types of ink droplets is kept constant over the forward pass and the return pass in main scanning.

<Driving the Ejection Heads>

Figure 7:
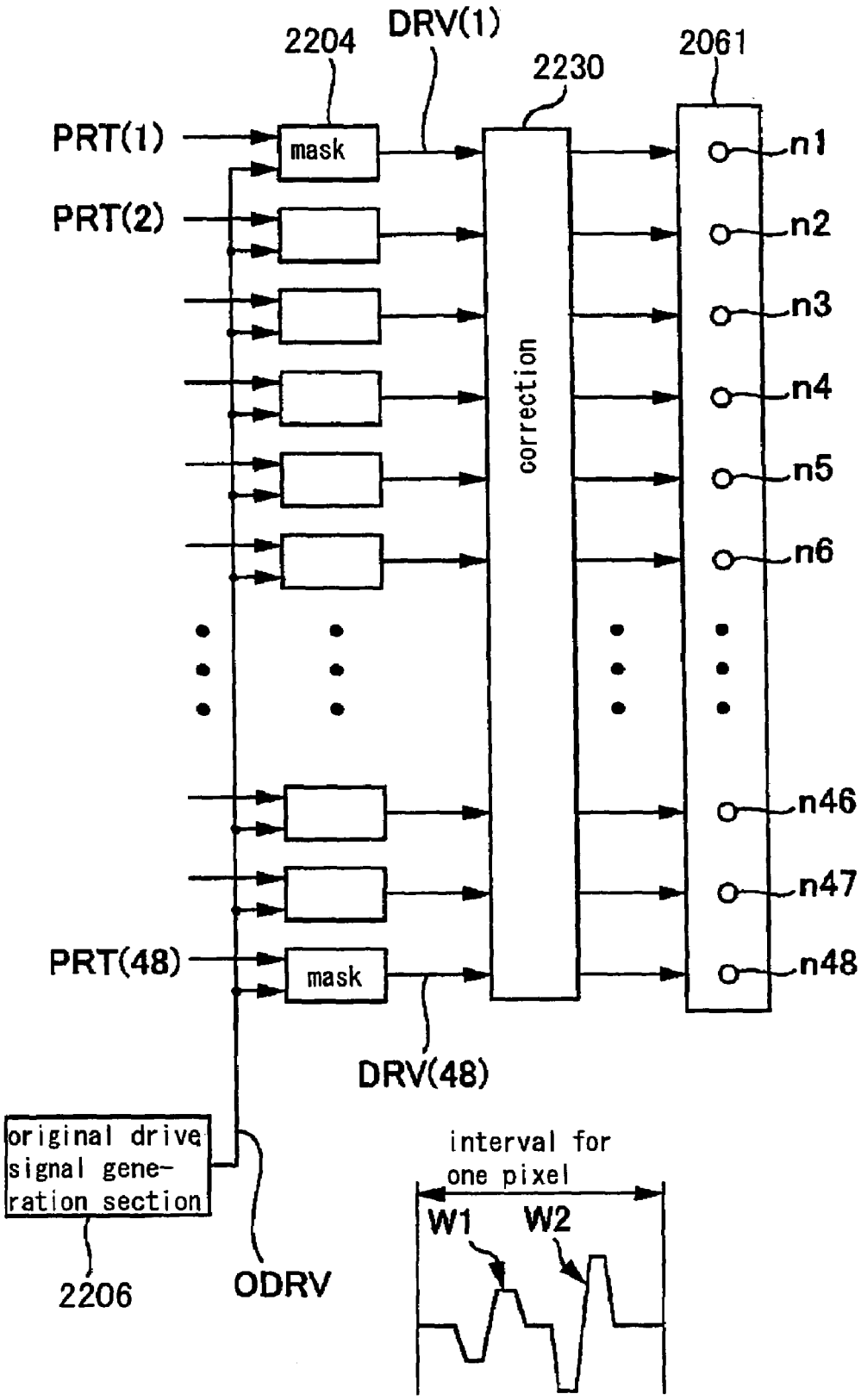
FIG. 7 is a block diagram showing the configuration of the drive signal generating section provided inside a head drive circuit 2052 (FIG. 2).
Figure 8:
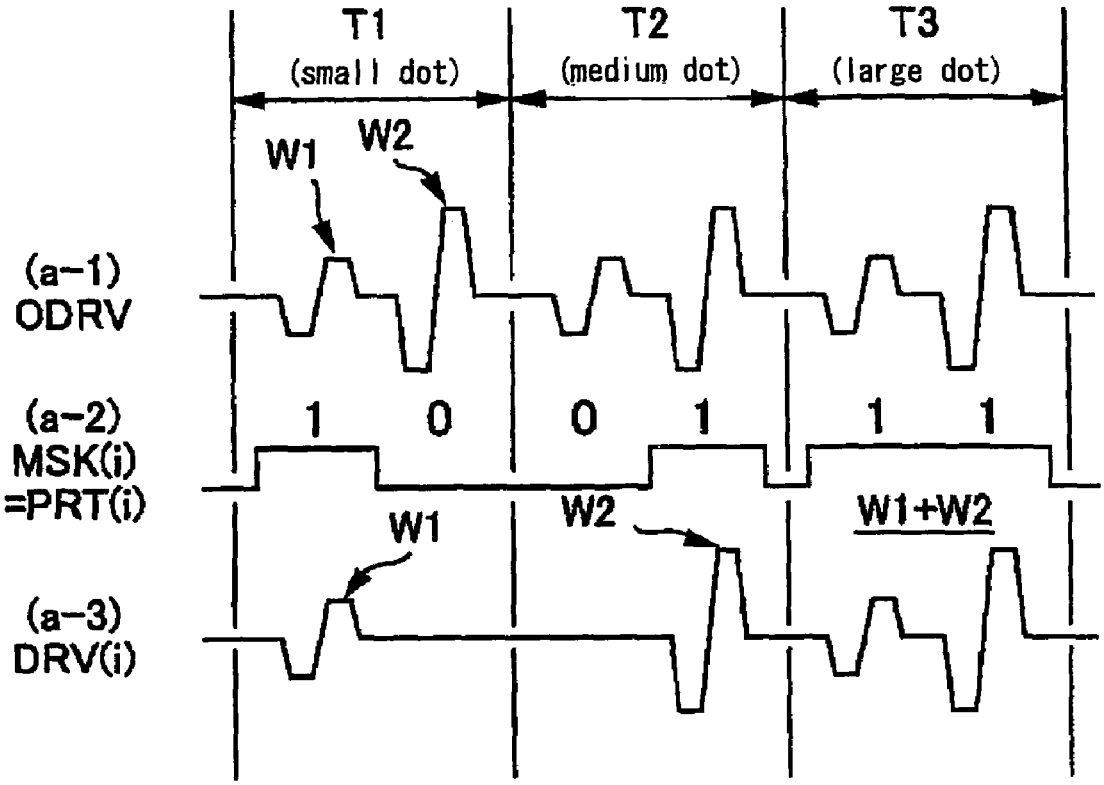
FIG. 8 is a timing chart showing the operation of the drive signal generating section.

Next, the driving of the ejection heads 2061 to 2066 is described with reference to FIG. 7 and FIG. 8. FIG. 7 is a block diagram showing the configuration of a drive signal generation section provided inside the head drive circuit 2052 (FIG. 2). FIG. 8 is a timing chart showing the operation of the drive signal generation section shown in FIG. 7.

In FIG. 7, the drive signal generation section is provided with a plurality of mask circuits 2204, an original drive signal generation section 2206, and a drive signal correction section 2230. The mask circuits 2204 are provided corresponding to the plurality of piezo elements for respectively driving the nozzles n1 to n48 of the ejection head 2061. It should be noted that in FIG. 7 the bracketed numbers following each signal name indicate the number of the nozzle to which that signal is supplied. The original drive signal generation section 2206 generates an original drive signal ODRV common to the nozzles n1 to n48. The original drive signal ODRV is a signal that includes two pulses, a first pulse W1 and a second pulse W2, during the main-scanning period for one pixel. The drive signal correction section 2230 carries out a correction by shifting, either forward or backward for the entire return pass, the timing of the drive signal waveforms shaped by the mask circuits 2204. By correcting the timing of the drive signal waveforms, misalignments in the positions where the ink droplets land during the forward pass and during the return pass are corrected. That is, the misalignment in the positions where dots are formed between the forward pass and the return pass is corrected.

As shown in FIG. 7, the serial print signal PRT(i), which has been input, is input to the mask circuits 2204 together with the original drive signal ODRV that is output from the original drive signal generation section 2206. The serial print signal PRT(i) is a serial signal with two bits per pixel, and each of the bits correspond to the first pulse W1 and the second pulse W2, respectively.

Also, the mask circuits 2204 are gates for masking the original drive signal ODRV in correspondence with the level of the serial print signal PRT(i) (i=1 to 48). In other words, when the serial print signal PRT(i) is at level 1, the mask circuits 2204 pass the pulses corresponding to the original drive signal ODRV without any change and supply them to the piezo elements as a drive signal DRV, whereas when the serial print signal PRT(i) is at level 0, the mask circuits 2204 block the pulses corresponding to the original drive signal ODRV.

When printing, as shown in FIG. 8 (*a*-1), the first pulse W1 and the second pulse T2 are generated in this order in each pixel period T1, T2, and T3 as the pulses of the original drive signal ODRV. It should be noted that "pixel period" is identical in meaning to the main-scanning period for one pixel. As described above, the mask circuits 2204 (FIG. 7) pass the pulses of the original drive signal ODRV without change when the serial print signal PRT(i) is at level 1, and block the pulses of the original drive signal ODRV when the serial print signal PRT(i) is at level 0.

Consequently, as shown in FIG. 8(*a*-2) and FIG. 8(*a*-3), when the two bits of the serial print signal PRT(i) in each pixel period are "1, 0", then only the first pulse W1 is output in the first half of the pixel period. Accordingly, a small dot that is small in size is formed on the printing medium. When the bits are "0,1," only the second pulse W2 is output in the second half of the pixel period. Accordingly, a medium dot that is medium in size is formed on the printing medium. And when the bits are "1, 1," both the first pulse W1 and the second pulse W2 are output. Accordingly, a large dot that is large in size is formed on the printing medium.

It should be noted that, as can be understood by looking at the drive signal waveform of the forward pass shown in FIG. 8(*a*-3), the three types of drive signals DRV(i) for recording three types of dots are shaped so that the drive signal waveforms are different from one another during the pixel period, that is, so that at least either the size or the number of ink droplets ejected from the nozzles is different. In other words, the drive signal DRV(i) in a single pixel period is shaped so that it has three types of waveforms that differ from one another in accordance with the three different values of the print signals PRT(i).

The same drive signal waveforms corresponding to these dots can be used for both the forward pass and the return pass of the main scanning. That is, small ink droplets, medium ink droplets, and large ink droplets ejected from one nozzle during a single pixel period are ejected in the same order and at the same interval in the forward pass and the return pass. However, although the same drive signal waveforms are used in the forward pass and the return pass of the main scanning, the timing thereof is shifted forward or backward by the drive signal correction section 2230 (FIG. 7) and corrected for the entire return pass. By correcting the timing, the positions where ink droplets land are intentionally shifted for the entire return pass, and misalignments in the positions where ink droplets land during the forward pass and the return pass are corrected.

<Overview of Correction of Dot Formation Position Misalignments in the Main-Scanning Direction>

Figure 9A:
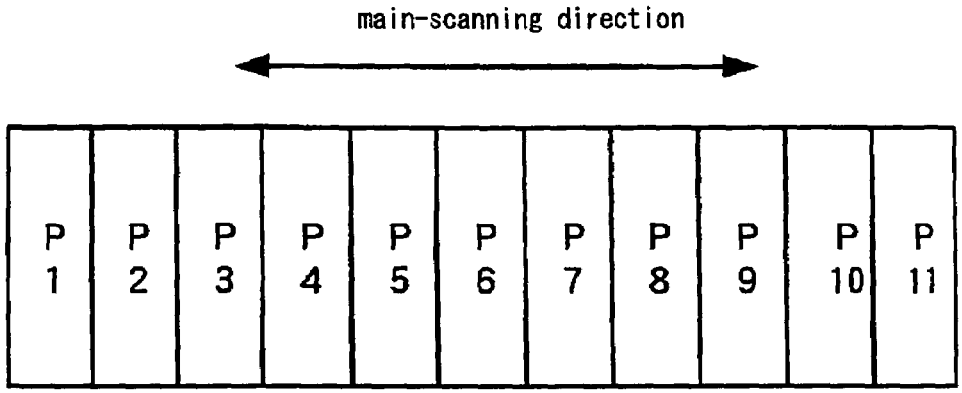
FIG. 9A and FIG. 9B are diagrams for illustrating an overview of a method for determining the correction value for misalignment adjustment based on the correction pattern.
Figure 9B:
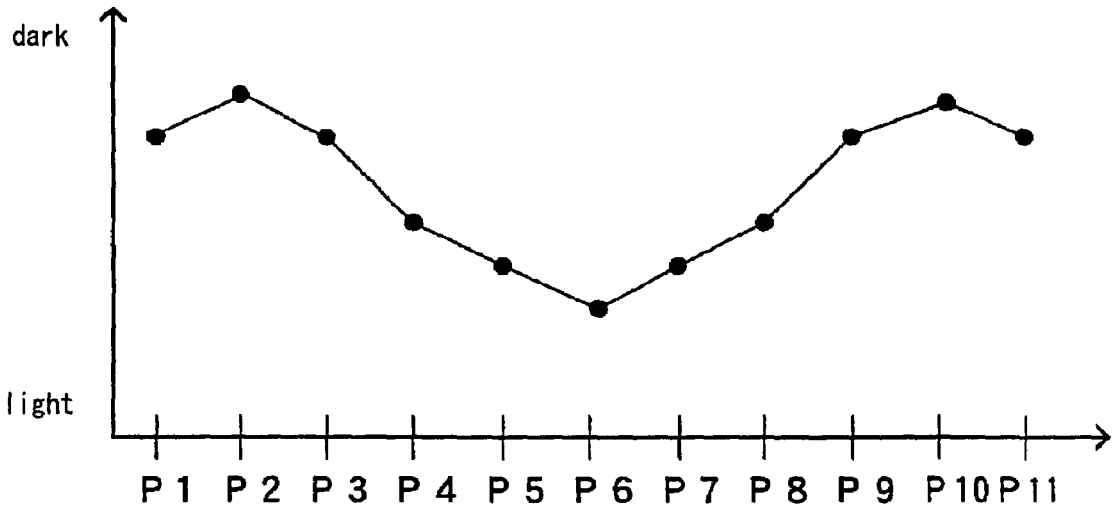

Next, an overview of the correction of misalignment in the dot formation position in the main-scanning direction is described with reference to FIG. 9A and FIG. 9B. FIG. 9A and FIG. 9B are diagrams for describing the gist of the method for determining the correction values for misalignment adjustment based on the correction pattern.

The method described hereinafter for correcting dot formation position misalignments is a method for intentionally shifting, for the entire return pass, the timing at which ink droplets are ejected in the return pass so that misalignments in the positions where dots are formed during the forward pass and the return pass do not stand out. It should be noted that it is also possible to intentionally shift the ejection timing of ink droplets in the forward pass for the entire forward pass, and it is also possible for the ejection timing of ink droplets in the forward pass and the return pass to be intentionally shifted over both the entire forward pass and return pass, respectively. Some causes of misalignments in the positions where dots are formed in the main-scanning direction during the forward pass and the return pass include variations in the speed at which the ink is ejected, backlash of the drive mechanism in the main-scanning direction, and warping of the platen supporting the print paper from below.

As shown in FIG. 9A, the correction pattern has eleven sub-patterns P1 to P11. Each sub-pattern P1 to P11 is printed by moving the ejection head 2028 back and forth in the main-scanning direction, and during which time, forming the dots on the print paper P with a specified row of nozzles (for example, the nozzles of the ejection head 2061).

In the forward pass, ink droplets are ejected onto the print paper P at a constant spacing (=1/180 inch). On the other hand, in the return pass, the ink droplets are similarly ejected at a constant spacing (=1/180 inch); however, for each sub-pattern P1 to P11, the ejection timing is shifted by 1/1440 inch in the sub-scanning direction.

For example, as for the sub-pattern P1 and the sub-pattern P2, assuming that ΔP1 is the misalignment between the ejection timing of the forward pass and the ejection timing of the return pass in the sub-pattern P1, and ΔP2 is the misalignment between the ejection timing of the forward pass and the ejection timing of the return pass in the sub-pattern P2, then |ΔP1−ΔP2|=1;1440 inch. Also, because 1/180 inch is equal to 8/1440 inch, when ΔP9 is assumed to be the misalignment between the ejection timing of the forward pass and the ejection timing of the return pass in the sub-pattern P9, which is eight sub-patterns away from the sub-pattern P1, then |ΔP1|=|ΔP9|.

In the sub-patterns P1 to P11 formed in this way, the closer the overlap between the dots formed on the print paper P in the forward pass and the dots formed on the print paper P in the return pass, the lighter the sub-pattern, and the smaller the overlap between the dots formed on the print paper P in the forward pass and the dots formed on the print paper P in the return pass, the darker the sub-pattern. FIG. 9B shows the darkness of each sub-pattern; in the correction pattern shown in FIG. 9A, it is lightest at the sub-pattern P6 and darkest at the sub-patterns P2 and P10.

In this embodiment, the two darkest sub-patterns are selected from the sub-patterns shown in FIG. 9A, and actual printing during the return pass is carried out according to an intermediate value between the ejection timings of the two sub-patterns at which they are printed in the return pass. That is, the intermediate value between the ejection timings at which the two sub-patterns are printed in the return pass is stored as the correction value, and by intentionally shifting the ejection timing of ink droplets for the entire return pass by the correction amount, the dot formation positions are corrected.

It should be noted that there is also a method of selecting the lightest sub-pattern using a sensor or by visual confirmation by the user and then adopting the conditions under which that sub-pattern was formed as the optimal value; however, for the sake of precision, it is more preferable that, as mentioned above, the two darkest sub-patterns are selected and the intermediate value between the ejection timings in the return pass at which these two sub-patterns are printed is taken as the optimal value. The reason for this is as follows.

In the case of a method of selecting the lightest sub-pattern using a sensor or by visual confirmation by the user and then adopting, as the optimal value, the conditions under which that sub-pattern was formed, if an adjacent sub-pattern is selected by mistake, the ejection timing on the return pass is shifted 1/1440 inch from the optimal value.

By contrast, although there are instances in which a neighboring sub-pattern is selected by mistake also with the method in which the two darkest sub-patterns are selected and the formation conditions of the sub-pattern located in the middle between these two sub-patterns is taken as the optimal value, the intermediate value between the return-pass ejection timings of. the two sub-patterns will be the optimal value even if the sub-pattern P1 adjacent to P2 and the sub-pattern P11 adjacent to P10 are selected by mistake, or even if the sub-pattern P3 adjacent to P2 and the sub-pattern P9 adjacent to P10 are selected by mistake.

Also, even if the sub-pattern P2 is correctly selected but the sub-pattern P11 is mistakenly selected for the other sub-pattern, or if the sub-pattern P10 is correctly selected but the sub-pattern P1 is mistakenly selected for the other sub-pattern, the intermediate value between the return-pass ejection timings of the two sub-patterns is shifted from the optimal value by only half of 1/1440 inch.

It should be noted that in this correction method, it is not necessary to carry out printing using all nozzles in the nozzle row. That is, in this correction method, it is only necessary to distinguish the shade of each sub-pattern is known, and thus, as long as those conditions are met, it is also possible to carry out printing of the sub-patterns with some of the nozzles of the nozzle row. For example, the sub-patterns can be formed by ejecting ink droplets only with the nozzles at the ends or in the center portion of the nozzle row. By doing this, the ink that is required for printing the correction pattern can be conserved.

<Method of Forming Correction Pattern Corresponding to Dot Size>

Figure 10A:
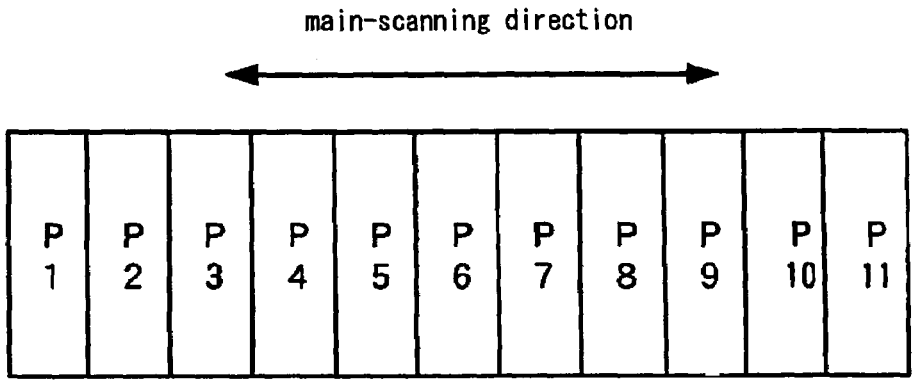
FIG. 10A and FIG. 10B are diagrams for illustrating a correction pattern formed by large dots.
Figure 10B:
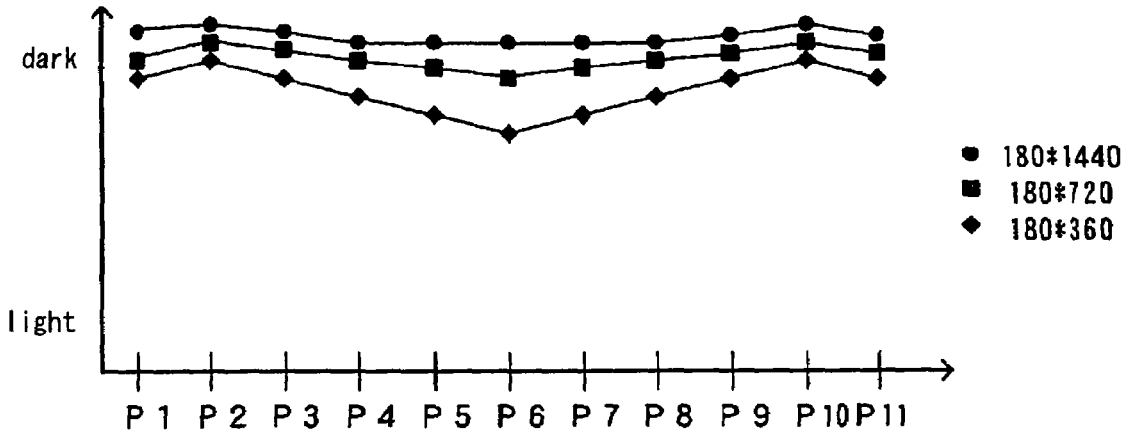
Figure 11A:
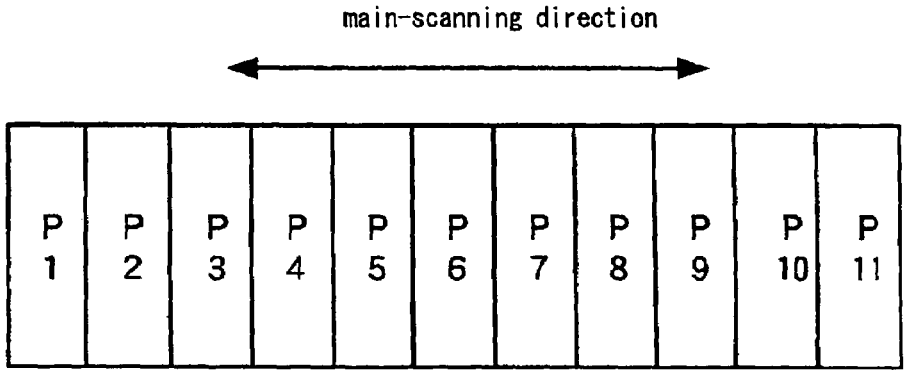
FIG. 11A and FIG. 11B are diagrams for illustrating a correction pattern formed by medium-sized dots.
Figure 11B:
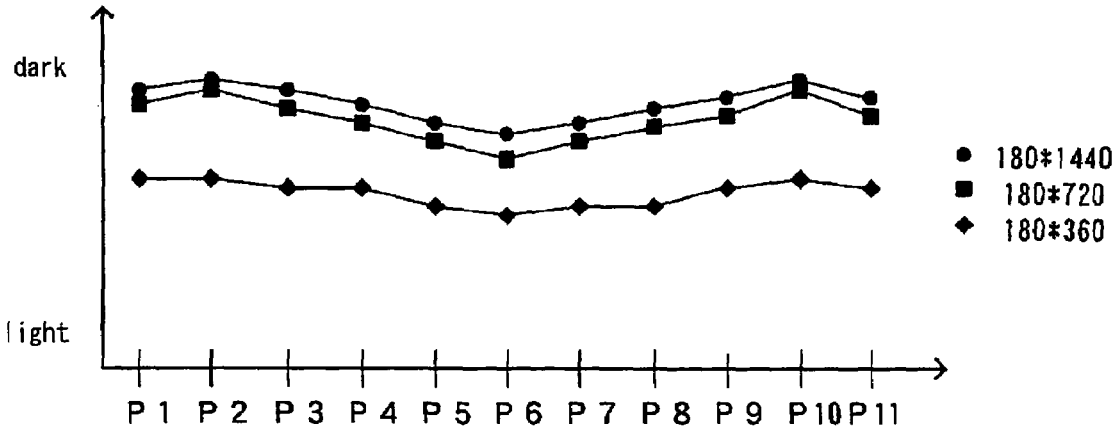
Figure 12A:
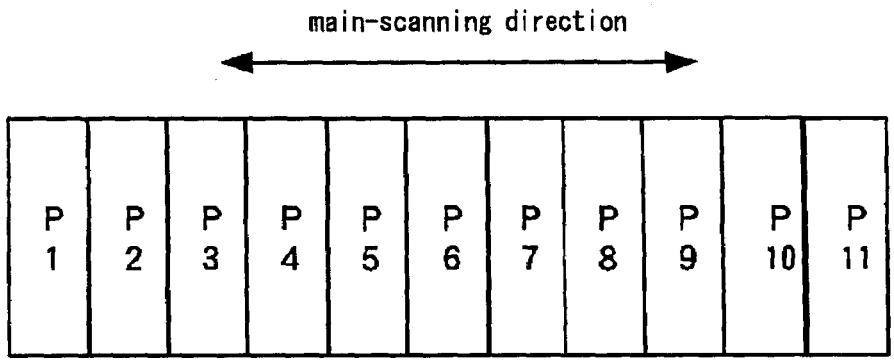
FIG. 12A and FIG. 12B are diagrams for illustrating a correction pattern formed by small dots.
Figure 12B:
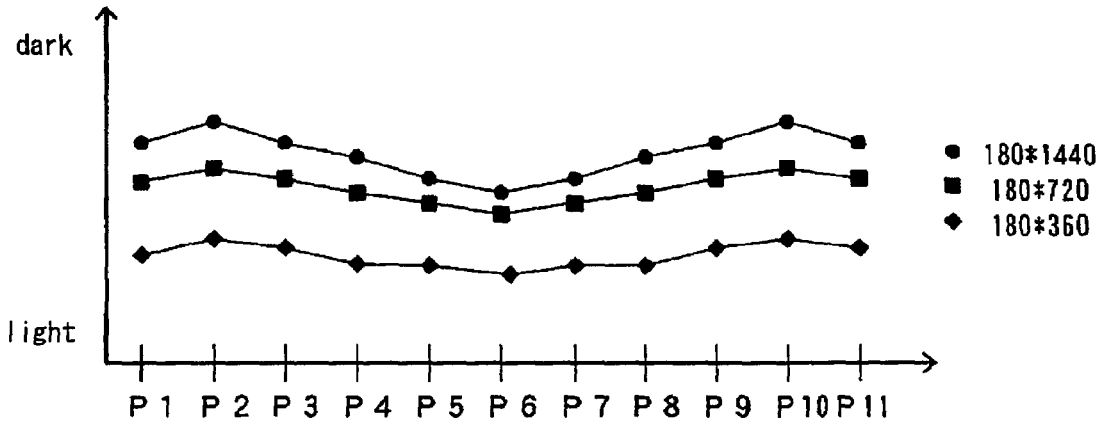

Next, a method for forming a correction pattern corresponding to the dot size is described with reference to FIG. 10A, FIG. 10B, FIG. 11A, FIG. 11B, FIG. 12A, and FIG. 12B. FIG. 10A and FIG. 10B are diagrams for describing the correction pattern formed by large dots. FIG. 11A and FIG. 11B are diagrams for describing the correction pattern formed by medium dots. FIG. 12A and FIG. 12B are diagrams for describing the correction pattern formed by small dots.

Misalignments in the positions where dots are formed are corrected based on the correction pattern as described above. Here, if the spacing between dots forming the correction pattern is the same in the main-scanning direction and the sub-scanning direction, then the correction pattern formed by large dots is darker than the correction pattern formed by medium dots, and the correction pattern formed by medium dots is darker than the correction pattern formed by small dots.

Consequently, even if the difference in shading among the sub-patterns is suitable in the correction pattern made of small dots formed with a certain spacing, in a correction pattern made of large dots formed with the same spacing, the difference in shading among the sub-patterns will not be suitable. That is, because each sub-pattern is very dark, the difference in shading among the sub-patterns becomes small.

Accordingly, in this embodiment, the spacing between dots, which form a correction pattern, in the sub-scanning direction is different according to the dot size. More specifically, the spacing between dots, forming a correction pattern, in the sub-scanning direction becomes larger in the order of small dots, medium dots, and large dots.

The sub-patterns P1 to P11 shown in FIG. 10A, FIG. 11A, and FIG. 12A are printed at the same ejection timing during both the forward and return passes. That is,when the misalignment between the ejection timing of the forward pass and the ejection timing of the return pass is set to ΔPi when printing each sub-pattern Pi (i=1 to 11), then ΔPi is the same in FIG. 10A, FIG. 11A, and FIG. 12A. Also, FIG. 10B, FIG. 11B, and FIG. 12B show the darkness of each sub-pattern, and both the vertical and horizontal axes are the same scale in FIG. 10B, FIG. 11B, and FIG. 12B. As is clear from comparing FIG. 10B, FIG. 11B, and FIG. 12B, the sub-patterns formed by large dots are generally darker than the sub-patterns formed by medium dots, and the sub-patterns formed by medium dots are generally darker than the sub-patterns formed by small dots.

In FIG. 10B, the circles that are plotted indicate the darkness of each sub-pattern when each sub-pattern is formed at a resolution of 180 dpi in the main-scanning direction and at a resolution of 1440 dpi in the sub-scanning direction, that is, the spacing between dots in the main-scanning direction is (1/180) inch and the spacing between dots in the sub-scanning direction is (1/1440) inch.

Also, the squares that are plotted indicate the darkness of each sub-pattern when each sub-pattern is formed at a resolution of 180 dpi in the main-scanning direction and at a resolution of 720 dpi in the sub-scanning direction, that is, the spacing between dots in the main-scanning direction is (1/180) inch and the spacing between dots in the sub-scanning direction is (1/720) inch.

Further, the diamonds that are plotted indicate the darkness of each sub-pattern when each sub-pattern is formed at a resolution of 180 dpi in the main-scanning direction and at a resolution of 360 dpi in the sub-scanning direction, that is, the dot spacing in the main-scanning direction is (1/180) inch and the dot spacing in the sub-scanning direction is (1/360) inch. It should be noted that the relationship between the circles, squares, and diamonds, and the dot spacing in the main-scanning direction and in the sub-scanning direction is the same in FIG. 11B and FIG. 12B.

As shown in FIG. 10, as for the sub-patterns P1 to P11 formed by large dots, if the resolution in the sub-scanning direction is set to 1440 dpi, all sub-patterns become dark, reducing the difference in shading among the sub-patterns. By contrast, the difference in darkness among the sub-patterns is increased as the resolution in the sub-scanning direction is lowered to 720 dpi and then to 360 dpi. Consequently, when forming a correction pattern using large dots, the resolution in the main-scanning direction is set to 180 dpi and the resolution in the sub-scanning direction is set to 360 dpi.

As shown in FIG. 11, as for the sub-patterns P1 to P11 formed by medium dots, when the resolution in the sub-scanning direction is set to 720 dpi, the difference in darkness among the sub-patterns becomes the largest. Consequently, when forming a correction pattern using medium dots, the resolution in the main-scanning direction is set to 180 dpi and the resolution in the sub-scanning direction is set to 720 dpi.

As shown in FIG. 12, as for the sub-patterns P1 to P11 formed by small dots, if the resolution in the sub-scanning direction is set to 360 dpi, all sub-patterns become light, reducing the difference in darkness among the sub-patterns. By contrast, the difference in darkness between the sub-patterns is increased as the resolution in the sub-scanning direction is raised to 720 dpi and then to 1440 dpi. Consequently, when forming a correction pattern using small dots, the resolution in the main-scanning direction is set to 180 dpi and the resolution in the sub-scanning direction is set to 1440 dpi.

It should be noted that the spacing in the main-scanning direction between dots forming the correction pattern is constant (for example, 180 dpi) regardless of the dot size. When the spacing between dots in the main-scanning direction is reduced, the correction pattern becomes darker. However, when the spacing in the main-scanning direction between dots constituting the correction pattern is reduced in order to raise the density of the correction pattern, there arises a problem that dots adjacent in the main-scanning direction bond with one another and cause blotting. From this standpoint, in this embodiment, the spacing in the main-scanning direction between dots forming a correction pattern is kept the same regardless of the dot size, thereby inhibiting the occurrence of bleeding.

Also, from the standpoint of preventing occurrence of blotting, it is preferable that the dot spacing in the main-scanning direction is at least two times the dot spacing in the sub-scanning direction, regardless of the dot size.

<Process for Correcting Dot Formation Positions>

Figure 13:
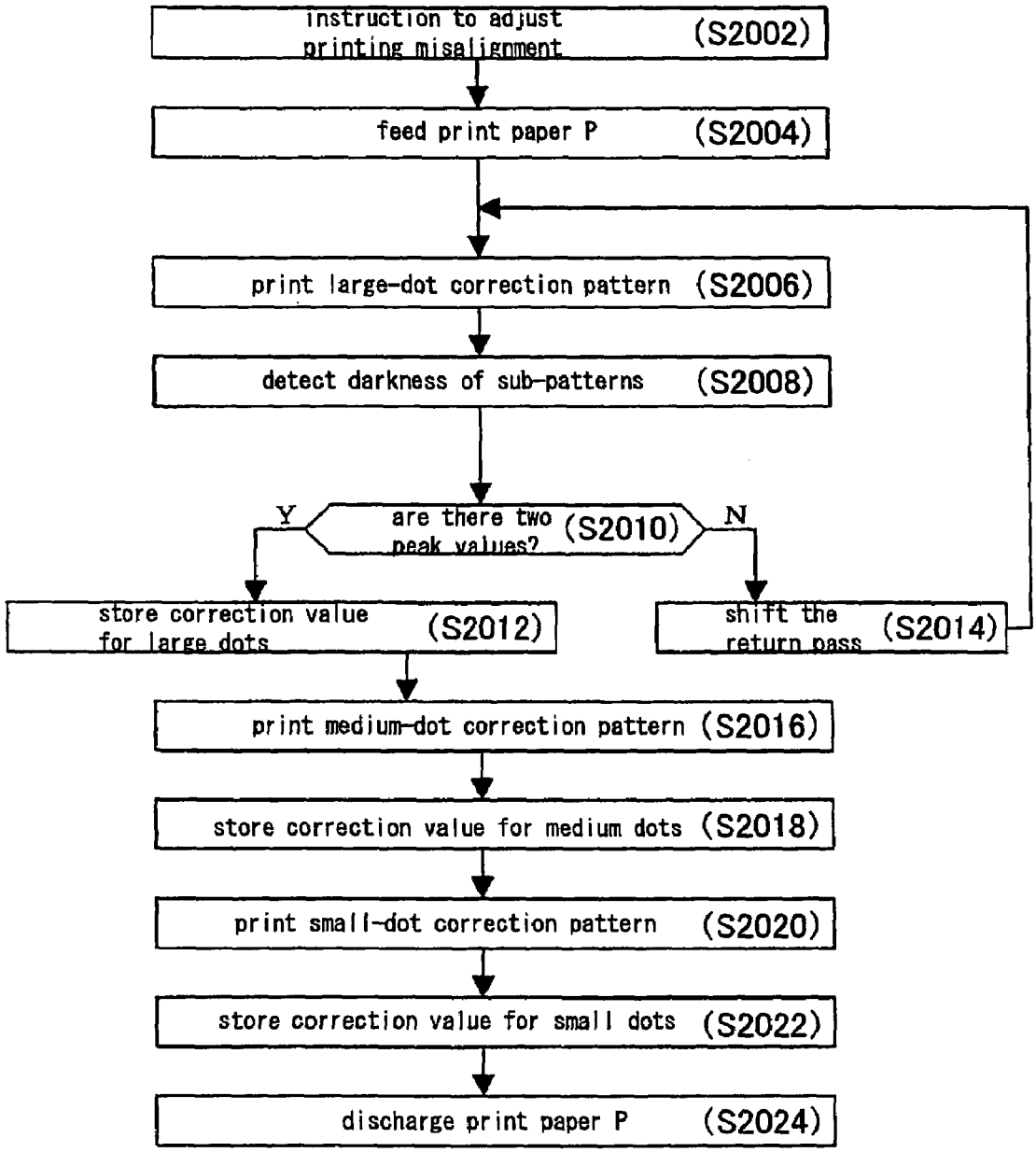
FIG. 13 is a flowchart for describing the process for correcting dot formation positions.
Figure 14:
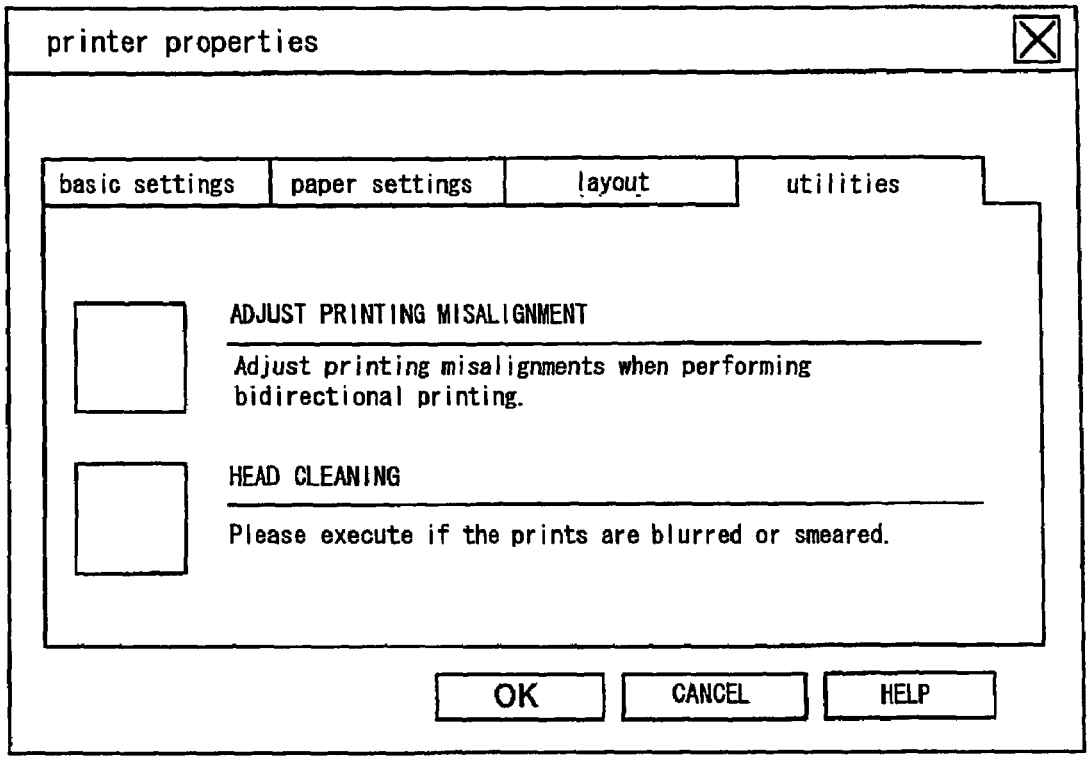
FIG. 14 is a diagram that schematically shows an example of the UI window through which a user designates print misalignment adjustment.
Figure 15:
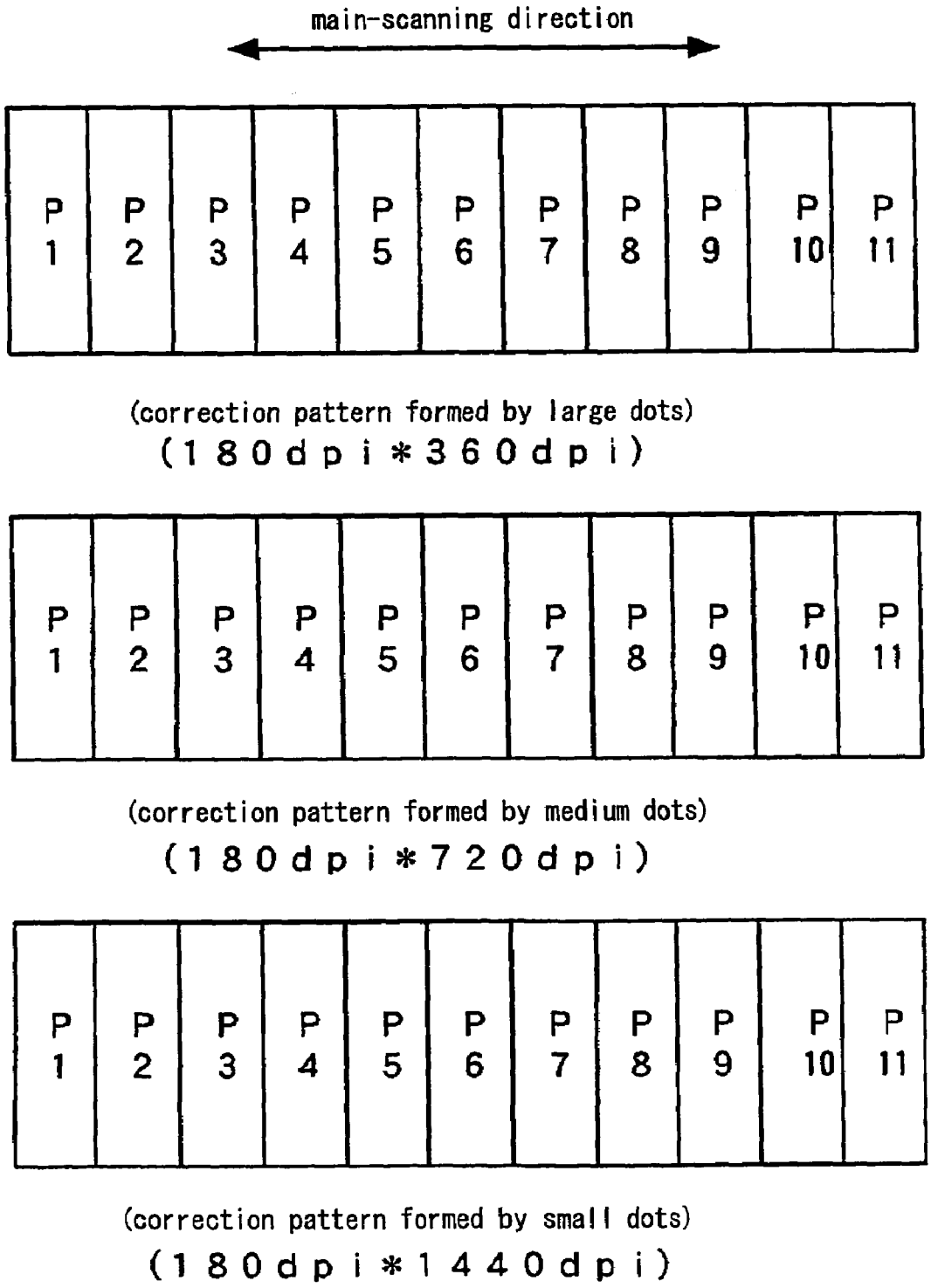
FIGS. 15 and 16 are diagrams showing an example of the correction pattern.
Figure 16:
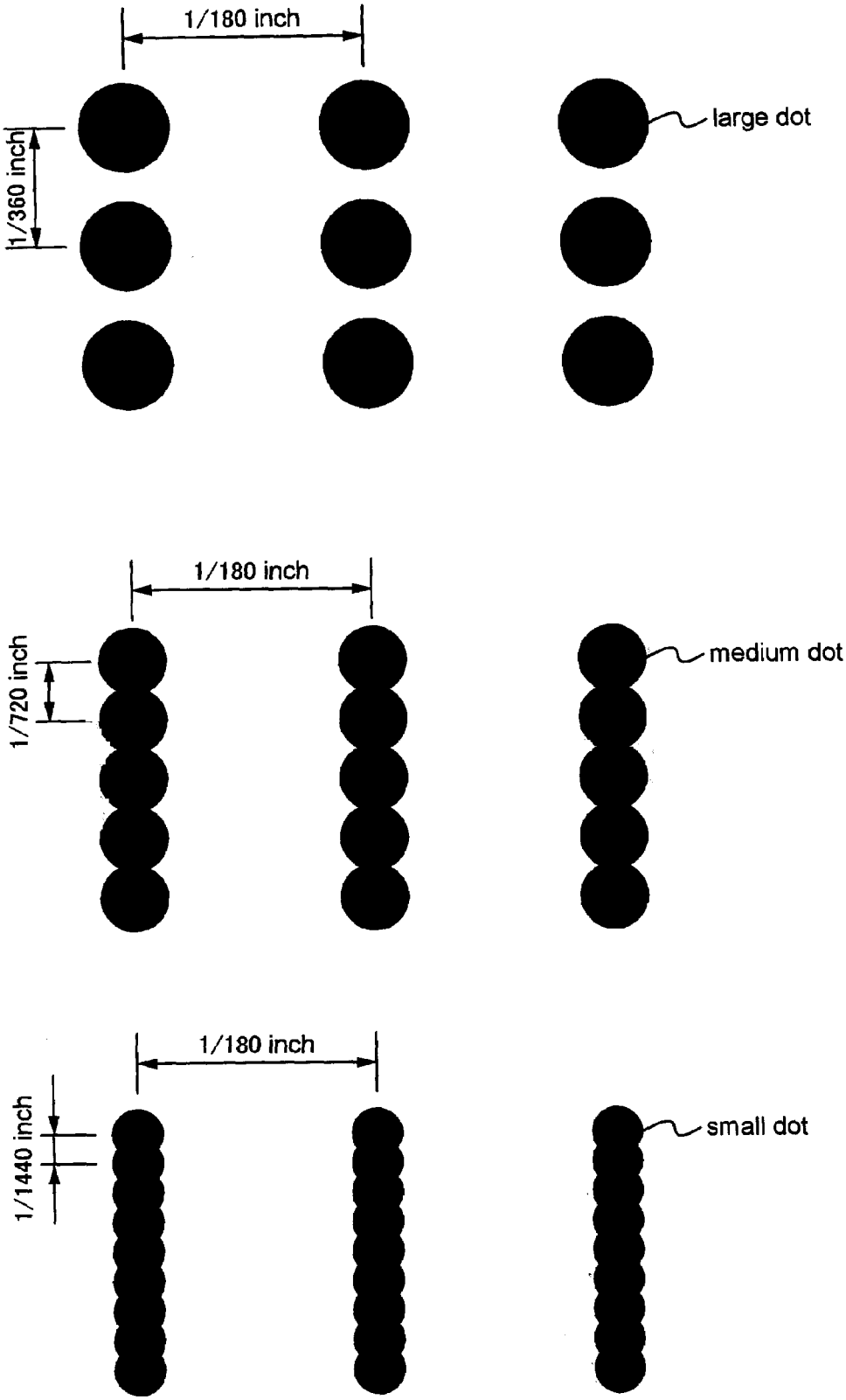

Next, the process for correcting the positions at which the dots are formed is described with reference to FIG. 13, FIG. 14, FIG. 15 and FIG. 16. FIG. 13 is a flowchart for describing the process for correcting dot formation positions. FIG. 14 is a diagram that schematically shows an example of a UI window through which a user makes a command to adjust printing misalignment. FIGS. 15 and 16 are diagrams showing an example of the correction pattern.

First, when, for example, a deterioration in image quality in bidirectional printing is noticed by the user, the user first gives, through a UI window such as that shown in FIG. 14, an instruction to adjust printing misalignment in order to adjust misalignments in the position where dots are formed in the forward and return passes in the main-scanning direction (step S2002). The screen for making this adjustment command is located under utilities, for example, in printer properties, and the user clicks the button corresponding to print misalignment adjustment (square button displayed in upper left of diagram) with a mouse, for example, so as to start the printing misalignment adjustment.

The instruction from the user to adjust the printing misalignments is transmitted to the printer 22 as a command. Based on the command received, the printer 2022 makes the paper-feed motor 2023 drive using the motor drive circuit 2054, for example, so as to supply the print paper P (step S2004).

Next, the printer 2022 makes the carriage motor 2024 and the paper-feed motor 2023 drive using the head drive circuit 2052 and the motor drive circuit 2054, for example, so as to print the correction pattern. An example of the correction pattern shown in FIGS. 15 and 16 are used in the following description.

First, large size ink droplets are ejected from the ejection head 2061 so as to print a correction pattern, that is, the sub-patterns P1 to P11, using large dots (step S2006). The dot resolution at this time is a resolution of 180 dpi in the main-scanning direction and a resolution of 360 dpi in the sub-scanning direction; that is, the dot spacing in the main-scanning direction is (1/180) inch, and the dot spacing in the sub-scanning direction is (1/360) inch. As mentioned above, when forming a correction pattern with large dots, the shade of the sub-patterns P1 to P11 becomes most conspicuous by printing at this resolution.

Next, light is emitted from the light-emitting section 2029*a* of the reflection-type optical sensor 2029 to each sub-pattern P1 to P11, the reflected light that is reflected is received by the light-receiving section 2029*b*, and the darkness of each sub-pattern P1 to P11 is detected based on the output value of the light-receiving section 2029*b* to correspond to the intensity of the reflected light that is received (step S2008).

Next, it is determined whether or not there are two sub-patterns having peak values in darkness among the sub-patterns P1 to P11 (step S2010).

If there are two sub-patterns having peak values in darkness among the sub-patterns P1 to P11, then the value in between the ejection timings at which these two sub-patterns were printed during the return pass is stored as the correction value for the large dots (step S2012).

If there is are no two sub-pattern that each have a peak value in darkness among the sub-patterns P1 to P11, then the ink ejection timing in the return pass is suitably shifted overall so that there are two sub-patterns having a peak value in darkness (step S2014).

Next, medium size ink droplets are ejected from the ejection head 2061 so as to print a correction pattern, that is, the sub-patterns P1 to P11, using medium dots (step S2016). The dot resolution at this time is a resolution of 180 dpi in the main-scanning direction and a resolution of 720 dpi in the sub-scanning direction; that is, a dot spacing in the main-scanning direction is (1/180) inch, and a dot spacing in the sub-scanning direction is (1/720) inch. As mentioned above, the shade of the sub-patterns P1 to P11 becomes most conspicuous by printing at this resolution when forming a correction pattern with medium dots.

Next, using these sub-patterns P1 to P11, the correction value for the medium dots is stored in the same manner as in the case of large dots (step S2018).

Further, small size ink droplets are ejected from the ejection head 2061 so as to print a correction pattern, that is, the sub-patterns P1 to P11, using small dots (step S2020). The dot resolution at this time is a resolution of 180 dpi in the main-scanning direction and a resolution of 1440 dpi in the sub-scanning direction; that is, a dot spacing in the main-scanning direction is (1/180) inch, and a dot spacing in the sub-scanning direction is (1/1440) inch. As mentioned above, the shade of the sub-patterns P1 to P11 becomes most conspicuous by printing at this resolution when forming a correction pattern with small dots.

Next, using these sub-patterns P1 to P11, the correction value for the small dots is stored in the same manner as in the case of large dots (step S2022).

Finally, the printer 2022 drives the paper-feed motor 2023 with the motor drive circuit 2054, for example, and discharges the print paper P (step S2024).

It should be noted that in the above-mentioned correction process, in step S2008, light is emitted from the light-emitting section 2029*a* of the reflection-type optical sensor 2029 to each sub-pattern P1 to P11, the reflected light that is reflected is received by the light-receiving section 2029*b*, and the darkness of each sub-pattern P1 to P11 is detected based on the output value of the light-receiving section 2029*b* corresponding to the intensity of the reflected light that is received; however, it is also possible for the user to detect the density of each sub-pattern by visually confirming it himself. In this case, the user visually confirms the sub-patterns P1 to P11 and selects the two sub-patterns having peak values in darkness. The printer 2022 receives information specifying the sub-patterns selected by the user as command information, and, based on this command information, stores the median between the ejection timings at which these two sub-patterns are printed during the return pass as the correction value.

<Other Considerations>

In the foregoing, a printing apparatus, for example, according to an aspect of the invention was described based on the present embodiment; however, the foregoing embodiment is for the purpose of facilitating understanding of the present invention and is not for the purpose of limiting the present invention. The invention can of course be altered and improved without departing from the gist thereof and includes functional equivalents.

Print paper was described as an example of the printing medium; however, it is also possible to use film, cloth, or sheet metal, for example, as the printing medium.

It is also possible to achieve a computer system having: a computer main unit; the printer according to the above-described embodiment connected to the computer main unit; and if necessary, an input device such as a mouse or a keyboard, a display device such as a CRT, a flexible disk drive device, and a CD-ROM drive device. A computer system achieved in this manner is superior to conventional systems as an overall system.

The printer according to the foregoing embodiment can also be given some of the functions or the mechanisms of a computer main unit, a display device, an input device, a flexible disk drive device, and a CD-ROM drive device. For example, the printer can be configured so as to have an image processing section for carrying out image processing, a display section for carrying out various types of displays, and a storage medium inserting/detaching section to/from which a storage medium storing image data captured by a digital camera or the like can be inserted and taken out.

A color inkjet printer was described in the present embodiment; however, the invention can also be applied to monochrome inkjet printers. The invention can also be applied to printers other than inkjet-type printers. The invention is generally applicable to printing apparatuses for printing to a printing medium, and, for example, can also be applied to facsimile apparatuses and copy machines. However, in so-called inkjet-type printing apparatuses, in which printing is carried out by ejecting ink from a print head, a particularly high image quality is demanded in the printed product, and thus an even larger benefit is obtained from the above-mentioned means.

Also, in the foregoing, printing misalignments were adjusted as requested by the user; however, they may also be adjusted automatically without a command from the user. Further, the above-mentioned adjustment and testing may be performed before the printing apparatus enters into the hands of the user, such as upon shipping.

All nozzles for each color can be corrected in accordance with a single correction value for each dot size, or the correction value for each dot size can be independently set for each nozzle group for which the ink droplet ejection timing can independently be corrected. It is also possible to independently set the correction values for each group of nozzle rows ejecting the same ink. For example, if there are two groups of nozzle rows that eject a particular ink, then the same correction value can be adopted for the nozzles of those two groups.

In the foregoing embodiment, position misalignments were corrected by adjusting the ejection timing of the return pass; however, it is also possible to correct position misalignments by adjusting the ejection timing of the forward pass. Also, it is also possible to correct position misalignments by adjusting the ejection timing of both the forward pass and the return pass. That is, position misalignments may be corrected by adjusting the ejection timing of at least either one of the forward pass or the return pass.

In the foregoing embodiment, some of the configuration that is achieved by hardware may be replaced with software, and, alternatively, some of the configuration that is achieved by software may be replaced with hardware.

According to the present embodiment, it becomes possible to prevent deterioration of image quality caused by differences in the printing characteristics during the forward pass and the return pass when carrying out bidirectional printing.

What is claimed is:

1. A printing apparatus comprising:

an ejection head moving in a first direction, said ejection head having a plurality of nozzles provided along a second direction which is different from said first direction, said plurality of nozzles selectively ejecting ink droplets of a plurality of sizes to form dots on a printing medium; and a controller for printing a first correction pattern and a second correction pattern, said first correction pattern and said second correction pattern enabling correction of a misalignment between a position at which dots are formed during a forward pass through which said head is moved and a position at which dots are formed during a return pass through which said head is moved, said first correction pattern and said second correction pattern are made of dots arranged in said first direction and said second direction, each dot that makes up said first correction pattern is a certain size, the size of each dot that makes up said second correction pattern is different from the size of said dots that make up said first correction pattern, a distance between the centers of neighboring dots arranged along said first direction of said first correction pattern and a distance between the centers of neighboring dots arranged along said first direction of said second correction pattern are limited to be the same distance, and a distance between the centers of neighboring dots arranged along said second direction of said first correction pattern is different from a distance between the centers of neighboring dots arranged along said second direction of said second correction pattern.

2. A printing apparatus according to claim 1, wherein said first correction pattern and said second correction pattern each have a plurality of sub-patterns, and each sub-pattern is made of dots arranged in said first direction and said second direction.

3. A printing apparatus according to claim 2, wherein each said sub-pattern has forward-pass dots that are formed with a predetermined distance in said first direction therebetween during said forward pass and return-pass dots that are formed with a predetermined distance in said first direction therebetween during said return pass, and an amount of misalignment between a position at which the forward-pass dots are formed and a position at which the return-pass dots are formed is different for each sub-pattern.

4. A printing apparatus according to claim 3, wherein said predetermined distance is at least twice the spacing in said second direction between the dots of said sub-pattern.

5. A printing apparatus according to claim 3, further comprising:

a density detection member for detecting a density of said sub-patterns;

wherein said misalignment is corrected based on a result of the density detected by said density detection member.

6. A printing apparatus comprising:

an ejection head moving in a first direction, said ejection head having a plurality of nozzles provided along a second direction which is different from said first direction, said plurality of nozzles selectively ejecting ink droplets of a plurality of sizes to form dots on a printing medium; and a controller for printing a first correction pattern and a second correction pattern, said first correction pattern and said second correction pattern enabling correction of a misalignment between a position at which dots are formed during a forward pass through which said head is moved and a position at which dots are formed during a return pass through which said head is moved, said first correction pattern and said second correction pattern are made of dots arranged in said first direction and said second direction, each dot that makes up said first correction pattern is a certain size, the size of each dot that makes up said second correction pattern is different from the size of said dots that make up said first correction pattern, a distance between the centers of neighboring dots arranged along said first direction of said first correction pattern and a distance between the centers of neighboring dots arranged along said first direction of said second correction pattern are limited to be the same distance, a distance between the centers of neighboring dots arranged along said second direction of said first correction pattern is different from a distance between the centers of neighboring dots arranged along said second direction of said second correction pattern, said printing apparatus is capable of receiving command information from a user based on said first correction pattern and said second correction pattern, and correcting said misalignment based on the command information.

7. A printing apparatus comprising:

an ejection head moving in a first direction, said ejection head having a plurality of nozzles provided along a second direction which is different from said first direction, said plurality of nozzles selectively ejecting ink droplets of a plurality of sizes to form dots on a printing medium; and a controller for printing a first correction pattern and a second correction pattern, said first correction pattern and said second correction pattern enabling correction of a misalignment between a position at which dots are formed during a forward pass through which said head is moved and a position at which dots are formed during a return pass through which said head is moved, said first correction pattern and said second correction pattern are made of dots arranged in said first direction and said second direction, each dot that makes up said first correction pattern is a certain size, the size of each dot that makes up said second correction pattern is different form the size of said dots that make up said first correction pattern, a distance between the centers of neighboring dots arranged along said first direction of said first correction pattern and a distance between the centers of neighboring dots arranged along said first direction of said second correction pattern are limited to be the same distance, a distance between the centers of neighboring dots arranged along said second direction of said first correction pattern is different from a distance between the centers of neighboring dots arranged along said second direction of said second correction pattern, said first correction pattern and said second correction pattern have a plurality of sub-patterns, each sub-pattern is made of dots arranged in said first direction and said second direction, each said sub-pattern has forward-pass dots that are formed with a predetermined distance in said first direction therebetween during said forward pass and return-pass dots that are formed with a predetermined distance in said first direction therebetween during said return pass;

an amount of misalignment between a position at which the forward-pass dots are formed and a position at which the return-pass dots are formed is different for each sub-pattern, said predetermined distance is at least twice the spacing in said second direction between the dots of said sub-pattern, said printing apparatus further comprises a density detection member for detecting a density of said sub-patterns, and said misalignment is corrected based on a result of the density detected by said density detection member.

8. A computer system comprising:

a computer main unit; and a printing apparatus that is connected to said computer main unit, said printing apparatus having an ejection head moving in a first direction, said ejection head having a plurality of nozzles provided along a second direction which is different from said first direction, said plurality of nozzles selectively ejecting ink droplets of a plurality of sizes to form dots on a printing medium; and a controller for printing a first correction pattern and a second correction pattern, said first correction pattern and said second correction pattern enabling correction of a misalignment between a position at which dots are formed during a forward pass through which said head is moved and a position at which dots are formed during a return pass through which said head is moved, said first correction pattern and said second correction pattern are made of dots arranged in said first direction and said second direction, each dot that makes up said first correction pattern is a certain size, the size of each dot that makes up said second correction pattern is different from the size of said dots that make up said first correction pattern, a distance between the centers of neighboring dots arranged along said first direction of said first correction pattern and a distance between the centers of neighboring dots arranged along said first direction of said second correction pattern are limited to be the same distance, and a distance between the centers of neighboring dots arranged along said second direction of said first correction pattern is different from a distance between the centers of neighboring dots arranged along said second direction of said second correction pattern.

9. A method of printing comprising:

moving an ejection head in a first direction, said ejection head having a plurality of nozzles provided along a second direction which is different from said first direction;

selectively ejecting ink droplets of a plurality of sizes from said plurality of nozzles to form dots on a printing medium;

printing a first correction pattern and a second correction pattern, said first correction pattern and said second correction pattern enabling correction of a misalignment between a position at which dots are formed during a forward pass through which said head is moved and a position at which dots are formed during a return pass through which said head is moved, said first correction pattern and said second correction pattern are made of dots arranged in said first direction and said second direction, each dot that makes up said first correction pattern is a certain size, and the size of each dot that makes up said second correction pattern is different from the size of said dots that make up said first correction pattern; and limiting a distance between the centers of neighboring dots arranged along said first direction of said first correction pattern and a distance between the centers of neighboring dots arranged along said first direction of said second correction pattern to be the same, wherein a distance between the centers of neighboring dots arranged along said second direction of said first correction pattern is different from a distance between the centers of neighboring dots arranged along said second direction of said second correction pattern.

* * * * *